US011172796B2

(12) United States Patent
Wayne et al.

(10) Patent No.: US 11,172,796 B2
(45) **Date of Patent: *Nov. 16, 2021**

(54) BLEACH DELIVERY SYSTEM AND METHOD FOR TOILET BIOFILM DISINFECTION

(71) Applicant: THE CLOROX COMPANY, Oakland, CA (US)

(72) Inventors: Kyle Wayne, Pleasanton, CA (US); Jason White, Pleasanton, CA (US); Yolande Sterling, Pleasanton, CA (US); Stacie Alvarez, Pleasanton, CA (US); Joseph McShane, Pleasanton, CA (US)

(73) Assignee: THE CLOROX COMPANY, Oakland, CA (US)

( * ) Notice: Subject to any disclaimer, the term of this patent is extended or adjusted under 35 U.S.C. 154(b) by 45 days.

This patent is subject to a terminal disclaimer.

(21) Appl. No.: 16/750,866

(22) Filed: Jan. 23, 2020

(65) Prior Publication Data

US 2020/0214515 A1 Jul. 9, 2020

Related U.S. Application Data

(63) Continuation of application No. 16/241,553, filed on Jan. 7, 2019, now Pat. No. 10,610,066.

(51) Int. Cl.
*A47K 7/02* (2006.01)
*A47K 11/10* (2006.01)
(Continued)

(52) U.S. Cl.
CPC ..... *A47K 11/10* (2013.01); *A47L 13/17* (2013.01); *C11D 3/395* (2013.01); *C11D 17/044* (2013.01); *C11D 17/049* (2013.01); *B08B 1/003* (2013.01)

(58) Field of Classification Search
CPC ..... A47L 13/17; A47K 11/10; C11D 3/395; C11D 17/044; C11D 17/049
See application file for complete search history.

(56) References Cited

U.S. PATENT DOCUMENTS 2,648,085 A 8/1953 Rodgers
2,752,625 A 7/1956 Ponsell
(Continued)

FOREIGN PATENT DOCUMENTS

EP 0313495 A1 4/1989
EP 1254950 A2 11/2002
(Continued)

*Primary Examiner* — Jennifer C Chiang
(74) *Attorney, Agent, or Firm* — Erin Collins

(57) ABSTRACT

Cleaning tools for cleaning toilets, particularly the interior of a toilet bowl, where bleach is provided within the cleaning tool itself, e.g., in a disposable, single use cleaning head. The tool may include a handle, a cleaning head attachable to the handle, a nonwoven material having an exterior surface and an interior surface, and a solid cleaning composition stored adjacent to the interior surface of the nonwoven material. The solid cleaning composition includes solid bleach, and may also include a solid surfactant. The cleaning composition may be confined within the nonwoven material (e.g., in a pouch), but upon contact with water, dissolved cleaning composition is able to migrate through the nonwoven material, through a scrubbing layer, and be delivered to the surface being cleaned. Release may achieve at least a 3-log reduction in *Staphylococcus aureus* within 5 minutes.

20 Claims, 4 Drawing Sheets

(51) Int. Cl.

| | |
|---|---|
| ***A47L 13/17*** | (2006.01) |
| ***C11D 17/04*** | (2006.01) |
| ***C11D 3/395*** | (2006.01) |
| *B08B 1/00* | (2006.01) |

(56) References Cited

U.S. PATENT DOCUMENTS

| | | | |
|---|---|---|---|
| 3,383,158 | A | 5/1968 | Leland |
| 3,413,673 | A | 12/1968 | Gewirz |
| 3,753,267 | A | 8/1973 | Johnson, Sr. |
| 3,875,609 | A | 4/1975 | Wells |
| 4,031,673 | A | 6/1977 | Hagelberg |
| 4,457,038 | A | 7/1984 | Hammond |
| 4,466,152 | A | 8/1984 | Moss et al. |
| 4,493,124 | A | 1/1985 | Agapiou |
| 4,523,347 | A | 6/1985 | Tames |
| 4,642,836 | A | 2/1987 | Bokmiller |
| 4,852,201 | A | 8/1989 | Wundrock et al. |
| 4,987,634 | A | 1/1991 | Weihrauch |
| 5,003,659 | A | 4/1991 | Paepke |
| 5,140,717 | A | 8/1992 | Castagliola |
| 5,381,809 | A | 1/1995 | Parker, Jr. |
| 5,407,594 | A | 4/1995 | Fry et al. |
| 5,419,015 | A | 5/1995 | Garcia |
| 5,471,697 | A | 12/1995 | Daconta |
| 5,658,874 | A | 8/1997 | Davies et al. |
| 5,862,565 | A | 1/1999 | Lundstedt |
| 5,888,002 | A | 3/1999 | Fenstersheit |
| 5,941,379 | A | 8/1999 | Barardo |
| 5,945,076 | A | 8/1999 | Leonard et al. |
| D413,470 | S | 9/1999 | Burton |
| 6,094,771 | A | 8/2000 | Egolf et al. |
| 6,154,913 | A | 12/2000 | Burton |
| 6,191,100 | B1 | 2/2001 | Askew et al. |
| 6,217,889 | B1 | 4/2001 | Lorenzi et al. |
| RE37,190 | E | 5/2001 | Stowell et al. |
| 6,290,781 | B1 | 9/2001 | Brouillett, Jr. |
| 6,295,688 | B1 | 10/2001 | Sayles et al. |
| 6,303,556 | B1 | 10/2001 | Kott et al. |
| 6,313,086 | B1 | 11/2001 | Askew et al. |
| 6,355,607 | B1 | 3/2002 | Rahman et al. |
| 6,405,403 | B1 | 6/2002 | McKay |
| 6,413,928 | B1 | 7/2002 | Painter et al. |
| 6,426,111 | B1 | 7/2002 | Hirsch |
| 6,485,212 | B1 | 11/2002 | Bomgaars et al. |
| 6,523,213 | B1 | 2/2003 | Post |
| 6,569,261 | B1 | 5/2003 | Aubay et al. |
| 6,611,986 | B1 | 9/2003 | Seals |
| 6,716,805 | B1 | 4/2004 | Sherry et al. |
| 6,814,088 | B2 | 11/2004 | Barnabas et al. |
| 7,048,806 | B2 | 5/2006 | Ochomogo et al. |
| 7,127,768 | B2 | 10/2006 | Blum et al. |
| 7,275,276 | B2 | 10/2007 | Jaszenovics et al. |
| 7,386,910 | B2 | 6/2008 | Minkler et al. |
| 7,446,082 | B2 | 11/2008 | Kilkenny et al. |
| 7,470,652 | B2 | 12/2008 | Kilkenny et al. |
| 8,286,295 | B2 | 10/2012 | Minkler et al. |
| 2002/0002125 | A1 | 1/2002 | Colurciello, Jr. et al. |
| 2002/0007527 | A1 | 1/2002 | Hart |
| 2002/0032137 | A1 | 3/2002 | DeSenna et al. |
| 2002/0061831 | A1 | 5/2002 | Kaziska et al. |
| 2002/0083542 | A1 | 7/2002 | Hart |
| 2002/0173442 | A1 | 11/2002 | Smith et al. |
| 2002/0187918 | A1 | 12/2002 | Urban |
| 2003/0070246 | A1 | 4/2003 | Cavalheiro |
| 2003/0100465 | A1 | 5/2003 | Kilkenny et al. |
| 2003/0216281 | A1 | 11/2003 | DeLeo et al. |
| 2004/0255418 | A1 | 12/2004 | Minkler et al. |
| 2005/0055787 | A1 | 3/2005 | Blum et al. |
| 2005/0056558 | A1 | 3/2005 | Belser et al. |
| 2005/0066465 | A1 | 3/2005 | Minkler et al. |
| 2005/0079987 | A1 | 4/2005 | Cartwright et al. |
| 2005/0124519 | A1 | 6/2005 | Sherry et al. |
| 2005/0138742 | A1 | 6/2005 | Jaszenovics et al. |
| 2005/0155628 | A1 | 7/2005 | Kilkenny et al. |
| 2005/0155630 | A1 | 7/2005 | Kilkenny et al. |
| 2005/0155631 | A1 | 7/2005 | Kilkenny et al. |
| 2005/0229344 | A1 | 10/2005 | Mittelstaedt et al. |
| 2005/0246849 | A1 | 11/2005 | Minkler et al. |
| 2006/0234899 | A1 | 10/2006 | Nekmard et al. |
| 2007/0094827 | A1 | 5/2007 | Kilkenny et al. |
| 2007/0191252 | A1 | 8/2007 | Kilkenny et al. |
| 2007/0191253 | A1 | 8/2007 | Kilkenny et al. |
| 2008/0022472 | A1 | 1/2008 | Minkler et al. |
| 2008/0115302 | A1 | 5/2008 | Kilkenny et al. |
| 2009/0152132 | A1 | 6/2009 | Wang |
| 2009/0165228 | A1 | 7/2009 | Kilkenny et al. |
| 2010/0223743 | A1 | 9/2010 | Minkler et al. |
| 2013/0014337 | A1 | 1/2013 | Minkler et al. |
| 2014/0157535 | A1 | 1/2014 | Minkler et al. |
| 2015/0097140 | A1 | 4/2015 | Rumberger et al. |

FOREIGN PATENT DOCUMENTS

| | | | |
|---|---|---|---|
| GB | 2362565 | A | 11/2001 |
| JP | 09135728 | A | 5/1997 |
| JP | 2000308600 | A | 11/2000 |
| WO | 8700411 | A1 | 1/1987 |
| WO | 0034422 | A2 | 6/2000 |
| WO | 0071012 | A1 | 11/2000 |
| WO | 0115587 | A1 | 3/2001 |
| WO | 0126499 | A1 | 4/2001 |
| WO | 0130954 | A1 | 5/2001 |
| WO | 0143618 | A1 | 6/2001 |
| WO | 0149818 | A1 | 7/2001 |

BLEACH DELIVERY SYSTEM AND METHOD FOR TOILET BIOFILM DISINFECTION

CROSS-REFERENCE TO RELATED APPLICATIONS

The present application is a continuation of and claims the benefit of U.S. patent application Ser. No. 16/241,553 filed on Jan. 7, 2019. The disclosure of the foregoing application is herein incorporated by reference in its entirety.

BACKGROUND OF THE INVENTION

1. The Field of the Invention

The present invention relates to cleaning tools, e.g., particularly tools for disinfecting toilets and the like.

2. Description of Related Art

While various cleaning tools are available for toilet cleaning, there is a continuing need for additional devices that are both convenient, easy to use, and which would provide additional functionality or efficacy that is not currently available. The present disclosure describes such devices, and methods for their manufacture and use.

BRIEF SUMMARY

The present invention relates to a cleaning tool that is specifically configured to provide removal and/or disinfection of biofilms from toilets or similar surfaces (e.g., urinals, etc.), that is also convenient and easy to use. While the devices are particularly suitable for use in such bathroom environments, and toilet cleaning in particular, they may also prove beneficial in cleaning showers, sinks, bathtubs, and the like. For example, Applicant is not aware of existing toilet cleaning brushes or pads that attach to a wand that contain bleach, and are capable of disinfecting and/or removing biofilms from toilets. In an embodiment, the present invention is directed to a cleaning tool including a handle, a cleaning head attached to or attachable to the handle, and a nonwoven material having an exterior surface and an interior surface, where a solid cleaning composition is stored adjacent the interior surface of the nonwoven material. The solid cleaning composition may include at least a solid bleach (e.g., a solid bleach and a solid surfactant). The cleaning composition may dissolve in water and releases from the nonwoven material so as to achieve at least a 3-log reduction in *Staphylococcus aureus* within 5 minutes of exposure time.

The solid cleaning composition and the configuration of the cleaning head which stores the solid cleaning composition may be configured to reduce or eliminate risk of inadvertent, premature release of the bleach (or surfactant) from the cleaning device. For example, it will be appreciated that many bleaches, particularly chlorine bleaches can undesirably permanently bleach (i.e., stain) clothing, towels, or the like that may be present in such a bathroom environment. Thus, the cleaning tool may be particularly configured to carefully confine and store the solid bleach so as to prevent or at least reduce risk of such unwanted staining that could otherwise occur. For example, the bleach may be provided in solid form, rather than a liquid form, and the solid bleach may be contained within a closed but water permeable "pouch" of the cleaning head, to better control its release therefrom, aiding a user to ensure that the bleach is properly delivered where intended (inside the toilet) rather than inadvertently being delivered where it may damage fabrics or other materials that may be present in the bathroom or similar environment.

An embodiment of the present invention is directed to a cleaning tool including a handle, a cleaning head attached to or attachable to the handle, an upper layer or other upper portion on the cleaning head, a nonwoven substrate on the cleaning head, and a solid cleaning composition retained by the nonwoven substrate. The solid cleaning composition may include a solid bleach and a solid surfactant. The nonwoven substrate provides at least 300 ppm of bleach for 5 minutes, in water (e.g., the toilet bowl water). The upper layer or portion may include the nonwoven substrate, with the solid cleaning composition retained therein, where a lower layer or other lower portion of the cleaning head is also provided, e.g., including a scrubbing layer portion.

Another embodiment of the present invention is directed to a cleaning tool including a handle, a cleaning head attached to or attachable to the handle, a nonwoven pouch on the cleaning head, and a solid cleaning composition stored within the nonwoven pouch. The solid cleaning composition includes a solid bleach and a solid surfactant. The cleaning composition dissolves in water and is released from the cleaning pouch to achieve at least a 3-log reduction in *Staphylococcus aureus* within 5 minutes.

Further features and advantages of the present invention will become apparent to those of ordinary skill in the art in view of the detailed description of preferred embodiments below.

BRIEF DESCRIPTION OF THE DRAWINGS

To further clarify the above and other advantages and features of the present invention, a more particular description of the invention will be rendered by reference to specific embodiments thereof which are illustrated in the drawings located in the specification. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

I. Definitions

Figure 1:
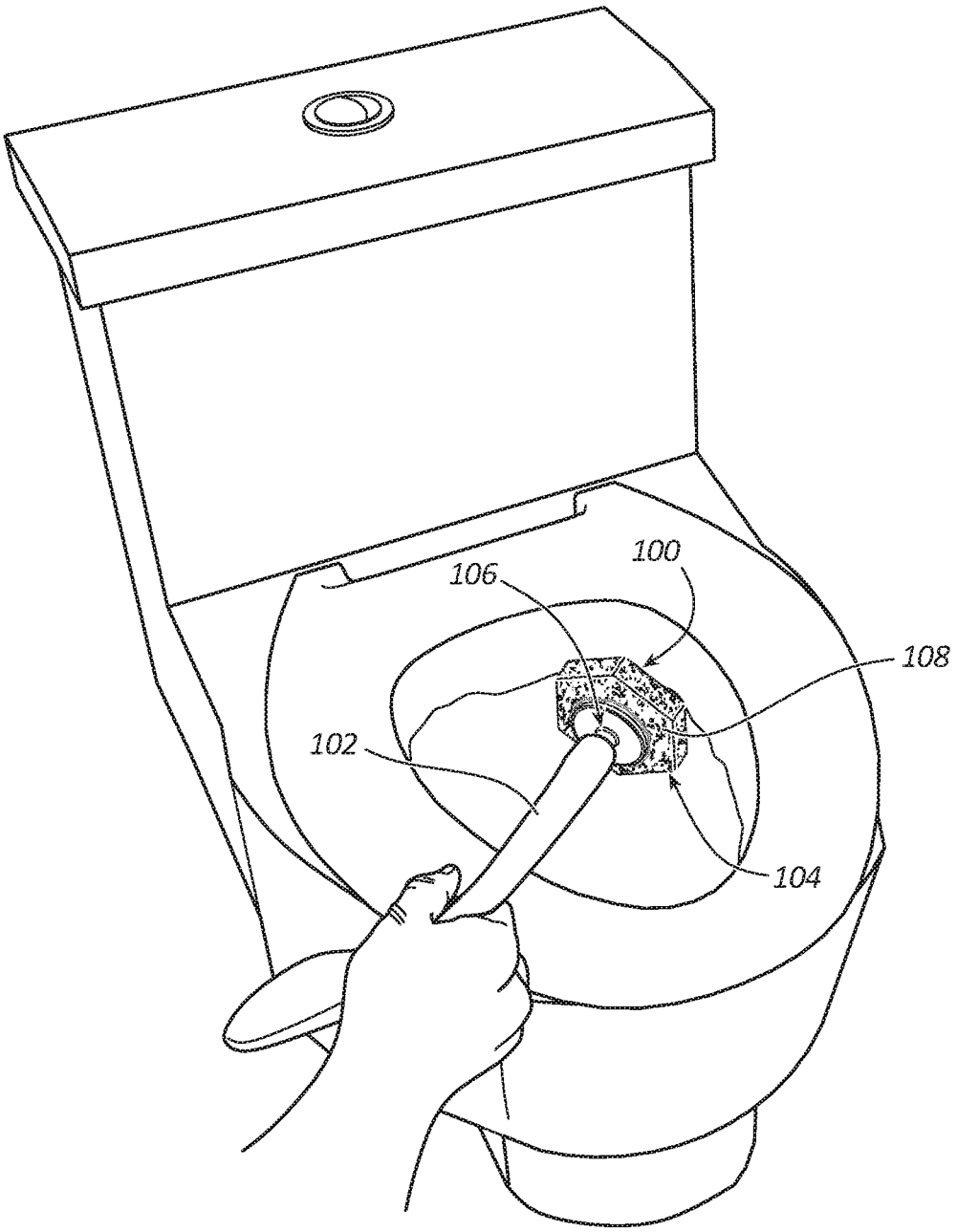
FIG. 1 is a perspective view showing use of an exemplary cleaning tool in an exemplary method of use to scrub the interior of a toilet bowl.

Before describing the present invention in detail, it is to be understood that this invention is not limited to particularly exemplified systems or process parameters that may, of course, vary. It is also to be understood that the terminology used herein is for the purpose of describing particular embodiments of the invention only, and is not intended to limit the scope of the invention in any manner.

All publications, patents and patent applications cited herein, whether supra or infra, are hereby incorporated by reference in their entirety to the same extent as if each individual publication, patent or patent application was specifically and individually indicated to be incorporated by reference.

The term "comprising" which is synonymous with "including," "containing," or "characterized by," is inclusive or open-ended and does not exclude additional, unrecited elements or method steps.

The term "consisting essentially of" limits the scope of a claim to the specified materials or steps "and those that do not materially affect the basic and novel characteristic(s)" of the claimed invention.

The term "consisting of" as used herein, excludes any element, step, or ingredient not specified in the claim.

It must be noted that, as used in this specification and the appended claims, the singular forms "a," "an" and "the" include plural referents unless the content clearly dictates otherwise. Thus, for example, reference to a "surfactant" includes one, two or more surfactants.

The compositions described herein may provide sanitization, disinfection, or sterilization. As used herein, the term "sanitize" shall mean the reduction of contaminants in the inanimate environment to levels considered safe according to public health ordinance, or that reduces the bacterial population by significant numbers where public health requirements have not been established. By way of example, an at least 99% reduction in bacterial population within a 24 hour time period is deemed "significant." Greater levels of reduction are possible, as are faster treatment times (e.g., within 1 minute), when sanitizing. As used herein, the term "disinfect" shall mean the elimination of many or all pathogenic microorganisms on surfaces with the exception of bacterial endospores. As used herein, the term "sterilize" shall mean the complete elimination or destruction of all forms of microbial life and which is authorized under the applicable regulatory laws to make legal claims as a "sterilant" or to have sterilizing properties or qualities. Some embodiments of the present compositions provide for at least a 2 or more log reduction in bacterial population within a designated time period (e.g., 1 minute, 3 minutes, or the like). A 2-log reduction is equivalent to a 99% reduction, a 3-log reduction is equivalent to at least a 99.9% reduction, a 4-log reduction is equivalent to at least a 99.99% reduction, a 5-log reduction is equivalent to at least a 99.999% reduction, etc.

Unless otherwise stated, all percentages, ratios, parts, and amounts used and described herein are by weight.

Numbers, percentages, ratios, or other values stated herein may include that value, and also other values that are about or approximately the stated value, as would be appreciated by one of ordinary skill in the art. As such, all values herein are understood to be modified by the term "about". A stated value should therefore be interpreted broadly enough to encompass values that are at least close enough to the stated value to perform a desired function or achieve a desired result, and/or values that round to the stated value. The stated values include at least the variation to be expected in a typical manufacturing or formulation process, and may include values that are within 10%, within 5%, within 1%, etc. of a stated value.

Some ranges may be disclosed herein. Additional ranges may be defined between any values disclosed herein as being exemplary of a particular parameter. All such ranges are contemplated and within the scope of the present disclosure.

In the application, effective amounts are generally those amounts listed as the ranges or levels of ingredients in the descriptions, which follow hereto. Unless otherwise stated, amounts listed in percentage ("%'s") are in weight percent (based on 100% active) of the composition.

The phrase 'free of' or similar phrases if used herein means that the composition comprises 0% of the stated component, that is, the component has not been intentionally added to the composition. However, it will be appreciated that such components may incidentally form, under some circumstances, as a byproduct or a reaction product from the other components of the composition, or such component may be incidentally present within an included component, e.g., as an incidental contaminant.

The phrase 'substantially free of' or similar phrases as used herein means that the composition preferably comprises 0% of the stated component, although it will be appreciated that very small concentrations may possibly be present, e.g., through incidental formation, as a byproduct or a reaction product from the other components of the composition, incidental contamination, or even by intentional addition. Such components may be present, if at all, in amounts of less than 1%, less than 0.5%, less than 0.25%, less than 0.1%, less than 0.05%, less than 0.01%, less than 0.005%, or less than 0.001%. In some embodiments, the compositions may be free or substantially free from any components not mentioned within this specification.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

II. Introduction

The present invention is directed to cleaning tools and related methods of manufacture and use. The cleaning tool is particularly useful in cleaning the interior and other surfaces of a toilet bowl, a urinal, or the like, although such tools could also find use in cleaning similar surfaces such as sinks, bathtubs, showers, and the like. While toilet bowl cleaning tools are currently available (e.g., CLOROX TOILET WAND), the existing tools do not include a bleach based disinfectant therein. For example, there are difficulties in attempting to provide such a bleach within a cleaning tool, due to the stability, staining potential, and other challenges associated with bleach, particularly chlorine bleaches.

The present cleaning tool includes a handle, a cleaning head attached to or attachable to the handle, a nonwoven material having exterior and interior surfaces, and a solid cleaning composition. The solid cleaning composition may include a solid bleach and a solid surfactant, which solid composition is stored adjacent the interior surface of the nonwoven material. For example, the nonwoven material may be configured as a "pouch", with the solid cleaning composition components stored inside the pouch. The nonwoven material may thus confine the solid composition particles therein, but also be water permeable, such that upon contact of the cleaning head with toilet water, the solid composition dissolves, and in its dissolved state, is released from the nonwoven material pouch. Dissolution and release of the cleaning composition from the cleaning head can be sufficient to achieve a desired log reduction in a target microbe within a given time frame. In one embodiment, the tool may provide a 3-log reduction in *Staphylococcus aureus* within 5 minutes.

III. Exemplary Cleaning Tools and Methods

Figure 2:
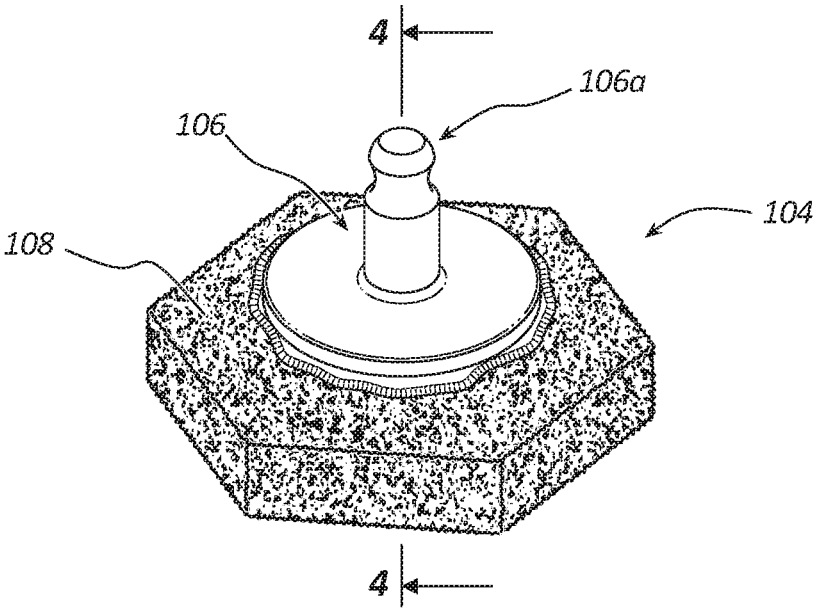
FIG. 2 is a perspective view of an exemplary cleaning head for the cleaning tool of FIG. 1 (i.e., without the handle attached).
Figure 3:
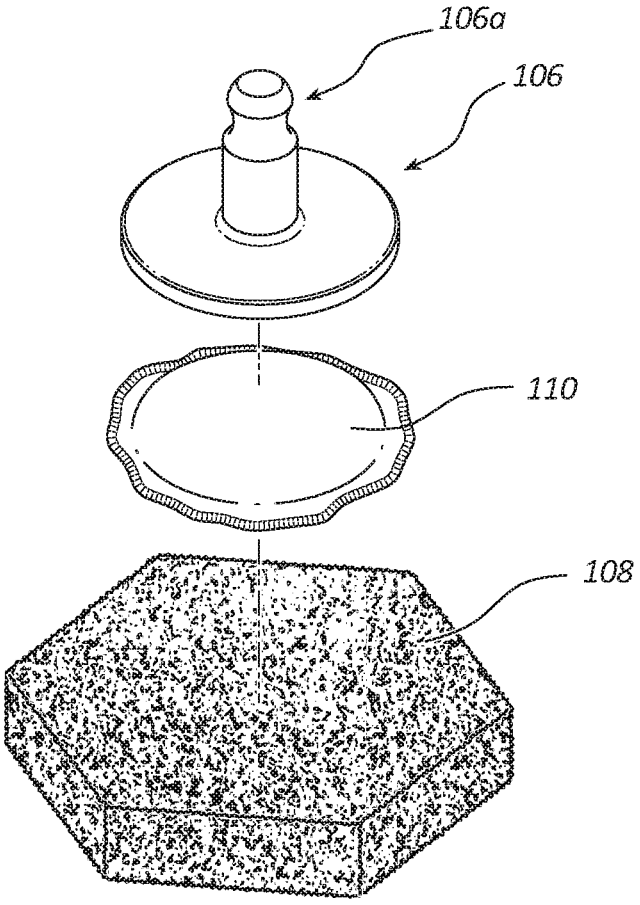
FIG. 3 is an exploded view of the cleaning head of FIG. 2, showing how the cleaning head includes a fitment for attaching a handle to the cleaning head, a scrubbing substrate for scrubbing the interior of a toilet bowl, and a nonwoven pouch which contains the solid cleaning composition.

FIGS. 1-3 illustrate an exemplary cleaning tool 100. Tool 100 is shown in FIG. 1 with handle 102 attached, while FIGS. 2 and 3 show the tool without handle 102, in order to better show the structures of the cleaning head 104. FIG. 3 shows an exploded view of cleaning head 104, showing the fitment 106 at an upper end of head 104, and a scrubbing member 108 at a lower end of head 104, with a nonwoven material 110 positioned between the fitment 106 and the scrubbing member 108. Fitment 106 may include a mechanical keyed structure (e.g., structure 106*a* as shown) that couples with a corresponding structure of handle 102, connecting handle 102 to cleaning head 104, through fitment 106. This coupling may be selective, such that the user can un-couple handle 102 from cleaning head 104, e.g., once the cleaning head has been used to clean the toilet bowl, as seen in FIG. 1. For example, the cleaning head may be disposable, allowing the user to clean the toilet bowl with a new cleaning head 104, and then discard the cleaning head 104 after the single cleaning use. By way of example, this uncoupling of the handle 102 from head 104 may be achieved by pressing or sliding a button or other manipulation of a control mechanism on handle 102.

This same control mechanism may allow attachment of a new cleaning head 104 into handle 102, when it is again time to clean the toilet bowl. For example, the cleaning heads 104 may be provided in a package including multiple such heads, arranged in a "fitment up" arrangement, so that the user simply pushes the handle down on fitment 106, locking the cleaning head to handle 102. The user then cleans the toilet bowl as shown in FIG. 1, after which the user is able to manipulate the control mechanism on handle 102, to allow the used, dirty cleaning head 104 to fall off handle 102 (e.g., into a trash can). The handle may then be stored until reuse when a new cleaning head is desired. This allows the user to clean the toilet bowl, and dispose of a used cleaning head 104 without ever having to physically touch the cleaning head, either to put it on handle 102, or remove it therefrom.

This benefit is particularly useful after cleaning the toilet, as almost any user will not want to touch such a used, dirty cleaning head. In addition, this characteristic is also beneficial when attaching the new, unused cleaning head to the handle, where a user may not want to touch the cleaning head, for various reasons (e.g., aesthetics, risk of bleach contact with the skin, etc.). Additional details of handle 102, fitment 106, and the like may be found in Applicant's U.S. Pat. Nos. 7,127,768 and 7,275,276, each of which is incorporated by reference herein in its entirety.

Figure 4:
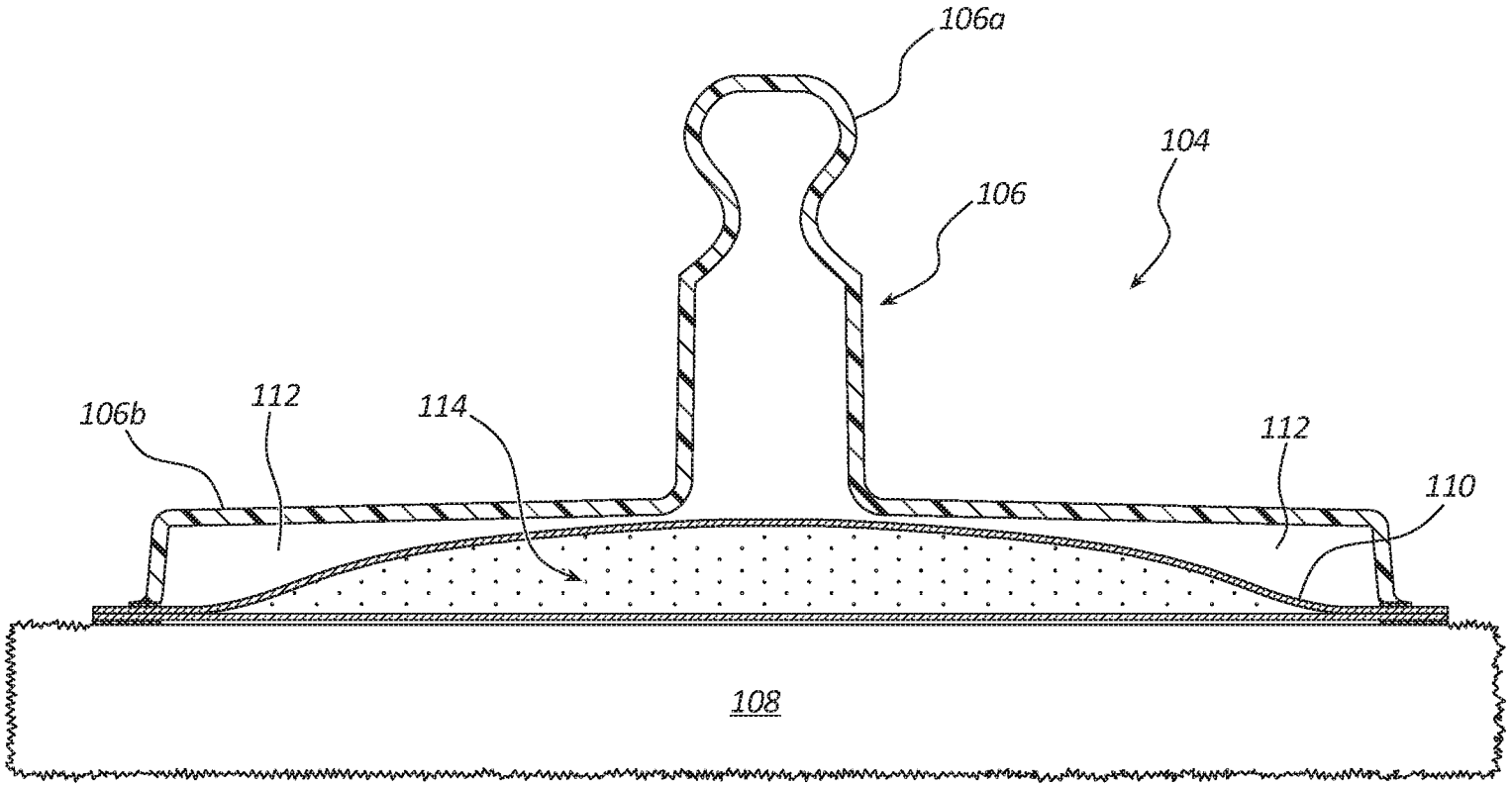
FIG. 4 shows a cross-sectional view through the assembled cleaning head of FIG. 2.

FIG. 4 shows a cross-sectional view through the cleaning head 104. Fitment 106 may include a lower portion 106*b*, in addition to keyed structure 106*a*. Lower portion 106*b* may provide an interior cavity 112 which is bounded by a wall associated with lower portion 106*b*, but which is open at the bottom thereof, at least with respect to fitment 106. The cavity 112 may include a nonwoven material 110 positioned therein, so that nonwoven 110 is housed within lower portion 106*b*, between fitment 106 (e.g., particularly lower portion 106*b* thereof) and scrubbing material 108. Nonwoven material 110 may be in the form of a pouch as shown, with a solid cleaning composition 114 stored therein.

The solid cleaning composition 114 may include both a solid bleach component and a solid surfactant component. In any case, at least a solid bleach component may be provided, e.g., particularly if a surfactant is otherwise provided (e.g., impregnated into the scrubbing layer, or the like). The solid cleaning composition is not a liquid, e.g., which aids in controlling release of the cleaning composition 114 until such time as release is actually desired. Various solid bleach and solid surfactant components may be suitable for use, although preferred solid bleach and solid surfactant components will not exhibit significant dusting characteristics (i.e., by which small particles (e.g., less than 1 mm, less than 0.5 mm, less than 0.1 mm) of the bleach would penetrate through the nonwoven, through the scrubbing layer, and cause a "dusting shower" of tiny bleach or surfactant particles from the cleaning head 104. For example, the selected solid bleach and solid surfactant may be formed from relatively larger particles, which do not readily disintegrate into very small particles that would present a "dusting" problem. At the same time, the particles may be small enough, so as to readily dissolve upon contact with water.

For example, the particles of the solid bleach and/or solid surfactant may average at least 1 mm, at least 2 mm, or at least 3 mm in size (e.g., from 2 mm to 5 mm, or from 2 mm to 3 mm in size). Such particles will be large enough so as to remain confined within the non-woven pouch, but are sufficiently small so as to provide relatively fast dissolution.

Another desirable characteristic of the solid bleach and solid surfactant materials relates to dissolution rate. For example, it is desired that the solid materials exhibit relatively fast dissolution (without exhibiting a dusting problem associated with very small particles), such that upon contact with the toilet water, the water quickly penetrates through the scrubbing layer, through the nonwoven substrate, and into cavity 112 where the water can dissolve solids 114. Some solid surfactant materials dissolve faster than other surfactant materials. Similarly, some solid bleach materials dissolve faster than other solid bleach materials. For example, it is desirable that the bleach and surfactant sufficiently dissolve within less than 1 minute of water contact, within 30 seconds of water contact, within 10 seconds of water contact, or within 5 seconds of water contact to provide the desired concentration of dissolved bleach and/or dissolved surfactant. For example, dissolution of the bleach may be sufficient within such time frames to provide a concentration of at least 300 ppm of bleach in water of the toilet bowl.

Non-limiting examples of solid bleach components that may be used include cyanurates such as isocyanurates, cyanuric acids, hypochlorites, intercalated bleach (e.g., magnesium intercalated bleach), hydantoins, N-halogen bleaches, borax-hypochlorites, amine-bleach combinations, solid peroxides, and the like. Examples of cyanurates include chloroisocyanurates (e.g., dichloroisocyanurates and trichloroisocyanurates), such as sodium dichloroisocyanurate, sodium trichloroisocyanurate, or other di- or tri-chloroisocyanurate salts. Examples of hypochlorites include sodium hypochlorite or calcium hypochlorite. Examples of hydantoins include monochlorohydantoin or dichlorohydantoin. The various bleach compounds may be salts of alkali metals, alkaline earth metals, various transition metals, or ammonium salts, as will be appreciated. Combinations of various solid bleach components can be used.

Further details of intercalated bleaches are disclosed in U.S. Pat. Nos. 9,040,475; 9,074,164, 9,353,336; 9,464,262; 9,580,671; 9,695,386, 9,963,659; and 10,100,271, each of which is incorporated herein by reference in its entirety.

Various solid bleaches will be apparent to those of skill in the art. In an embodiment, the solid bleach is a chlorine bleach that includes an associated characteristic "bleach" smell, rather than a non-chlorine bleach, such as a peroxide, which does not provide the same scented que as provided by a chlorine bleach. For example, while some find the scent of chlorine bleach to be undesirable, there is a significant fraction of users who appreciate the chlorine bleach scented que, correlating that que with an appreciation that effective disinfection or sanitization is occurring. As such, in some embodiments, the bleach comprises a chlorine bleach, and is provided in sufficient concentration so as to provide such a characteristic scented que upon its use.

In at least one embodiment, the solid bleach component comprises sodium dichloroisocyanurate. This particular solid bleach was found to exhibit little to no dusting issues, as it is able to maintain relatively larger particle sizes, even during manufacture and storage, is able to dissolve relatively quickly, and provides the desired scented que.

Various solid surfactants may be suitable for use. Examples may include nonionic, anionic, cationic, ampholytic, amphoteric, zwitterionic surfactants, and mixtures thereof. More specific examples may include sulfates, sulfonates, betaines, alkyl polysaccharides, (e.g., alkyl polyglycosides, also known as alkyl polyglucosides), amine oxides, tweens, alcohol ethoxylates, and combinations thereof, where such are available in solid form. The surfactants preferably exhibit similar dusting and dissolution characteristics as the solid bleach, in that they preferably do not tend to form a "dusting cloud" emanating from the cleaning head when a cleaning head including the solid components is shaken or otherwise handled.

Exemplary solid surfactants may include, but are not limited to sodium lauryl sulfate, sodium dodecylbenzene sulfonate, alpha olefin sulfonates, cocoamides (e.g., cocamide monoethanolamine) and the like. Combinations of more than one surfactant may be used. A preferred combination of solid bleach and solid surfactant is sodium dichloroisocyanurate and sodium dodecylbenzene sulfonate. At least some of the other tested solid materials exhibit dusting problems and/or slow dissolution characteristics. In addition to minimizing dusting and exhibiting relatively fast dissolution, it may be desirable for the solid surfactant to exhibit foaming characteristics.

A typical listing of anionic, ampholytic, and zwitterionic surfactants is given in U.S. Pat. No. 3,929,678 to Laughlin. A list of cationic surfactants is given in U.S. Pat. No. 4,259,217 to Murphy. Various alkyl polysaccharide surfactants are disclosed in U.S. Pat. No. 5,776,872 to Giret et al.; U.S. Pat. No. 5,883,059 to Furman et al.; U.S. Pat. No. 5,883,062 to Addison et al.; and U.S. Pat. No. 5,906,973 to Ouzounis et al. U.S. Pat. No. 4,565,647 to Llenado. Various nonionic surfactants can be found in U.S. Pat. No. 3,929,678 to Laughlin. Each of the above patents is incorporated by reference.

The solid surfactant to solid bleach concentration may be as desired. In an embodiment, they may be present at a ratio from 1:10 to 10:1, a ratio of 1:5 to 5:1, or a ratio of 1:3 to 3:1 by weight. The amount of solid bleach and solid surfactant provided in the nonwoven material may be sufficient to provide at least a given log reduction in *Staphylococcus aureus* or another target microbe within a given period. For example, the amount of bleach (and surfactant) may be tailored to provide at least a 3-log reduction of *Staphylococcus aureus* within 5 minutes.

In an embodiment, the amount of bleach may be sufficient to ensure a given bleach concentration in the toilet water, within a given time period. For example, the amount of solid bleach (and other characteristics of the cleaning head) may be sufficient to ensure that the toilet water being cleaned maintains a threshold concentration of bleach for a given period of time, after using the cleaning head to clean the toilet bowl. For example, the amount of bleach, the particular solid bleach selected, and the configuration of the nonwoven material, may be selected to ensure that the toilet bowl water will include 300 ppm of bleach within 10 seconds of exposure of the cleaning head to the toilet water, within 30 seconds of water exposure, within 45 seconds of water exposure, within 1 minute of water exposure, within 2 minutes of water exposure, or the like. So long as the toilet is not flushed, this threshold concentration may be maintained for at least 3 minutes, at least 5 minutes, or other time period.

For example, the instructions for use may instruct the user to scrub the interior of the toilet bowl after wetting the cleaning head, and to let the toilet sit for 3 minutes, 5 minutes, or the like after cleaning, in order to expose the interior surfaces of the toilet and the toilet water to a threshold level of bleach, for a desired period of time that is effective to provide a desired level of disinfection or sanitization. In one example, the cleaning head may provide a 300 ppm bleach concentration in the water in the toilet bowl for at least 5 minutes. Such threshold concentrations and exposure times can correspond to particular log reductions in *Staphylococcus aureus* or another target microbe (e.g., at least a 3-log reduction in *Staphylococcus aureus*).

By way of example, the cleaning head may include from 0.5 g to 25 g, from 0.5 g to 10 g of solid bleach, from 0.5 g to 5 g of solid bleach, from 1 g to 5 g, from 1 g to 3 g, or from 0.5 g to 2 g of solid bleach. Where the solid bleach composition is provided as a mixture of components, one of which is the bleach (e.g., various other salts may be provided therewith), the above amounts may refer to the bleach component itself. The surfactant may be included in the cleaning head in an amount of from 0.5 g to 25 g, from 0.5 g to 10 g, from 1 g to 10 g or from 2 g to 5 g.

The solid compositions will typically have no measurable pH value, as no significant water content is initially present. That said, upon contact with water, the solid compositions may provide a pH value (e.g., in the toilet water) that may be less than 9, less than 8, greater than 3, greater than 4, such as 5 to 8, or 5.5 to 7.5. Some bleaches exhibit increased stability at elevated pH values, although higher microefficacy is often provided at relatively lower pH, such as described herein. Because the bleach is provided in solid form, and only dissolved in water at the time of use, aqueous stability is less of a concern, and relatively lower pH values as noted above can be used.

The tool and solid bleach may be configured to provide a concentration of bleach in the toilet water that will reach at least 300 ppm, at least 350 ppm, at least 400 ppm, from 300 ppm to 5000 ppm, from 300 ppm to 3000 ppm, or from 300 ppm to 1000 ppm. This concentration may be maintained for at least 3 minutes, at least 4 minutes, at least 5 minutes, at least 6 minutes at least 7 minutes, at least 8 minutes, or at least 10 minutes, until the toilet is flushed. The combination of concentration threshold and time may be sufficient to achieve a 1-log, 2-log, 3-log, 4-log, 5-log, or 6-log reduction in *Staphylococcus aureus* or another target microbe.

In addition to the solid bleach and solid surfactant, other components may be included, either in the solid cleaning composition, or elsewhere in or on the cleaning head. Additional components may include fragrances, dyes, preservatives, desiccants, polymers, pH adjusters, buffers, and the like. A dye may be provided to provide a visual indication to the user that the cleaning composition is actually being dissolved into the water (e.g., turning the water a different color, such as blue, green, or the like). Such a dye may be provided in the nonwoven material, with the solid bleach and/or solid surfactant, or may alternatively be provided separate from the solid cleaning composition, e.g., disposed on or impregnated in the scrubbing material, the nonwoven material, or at another location of the cleaning head. For example, the dye could be provided dried on an absorbent layer (e.g., the scrubbing layer, the nonwoven, or the like).

Figure 5:
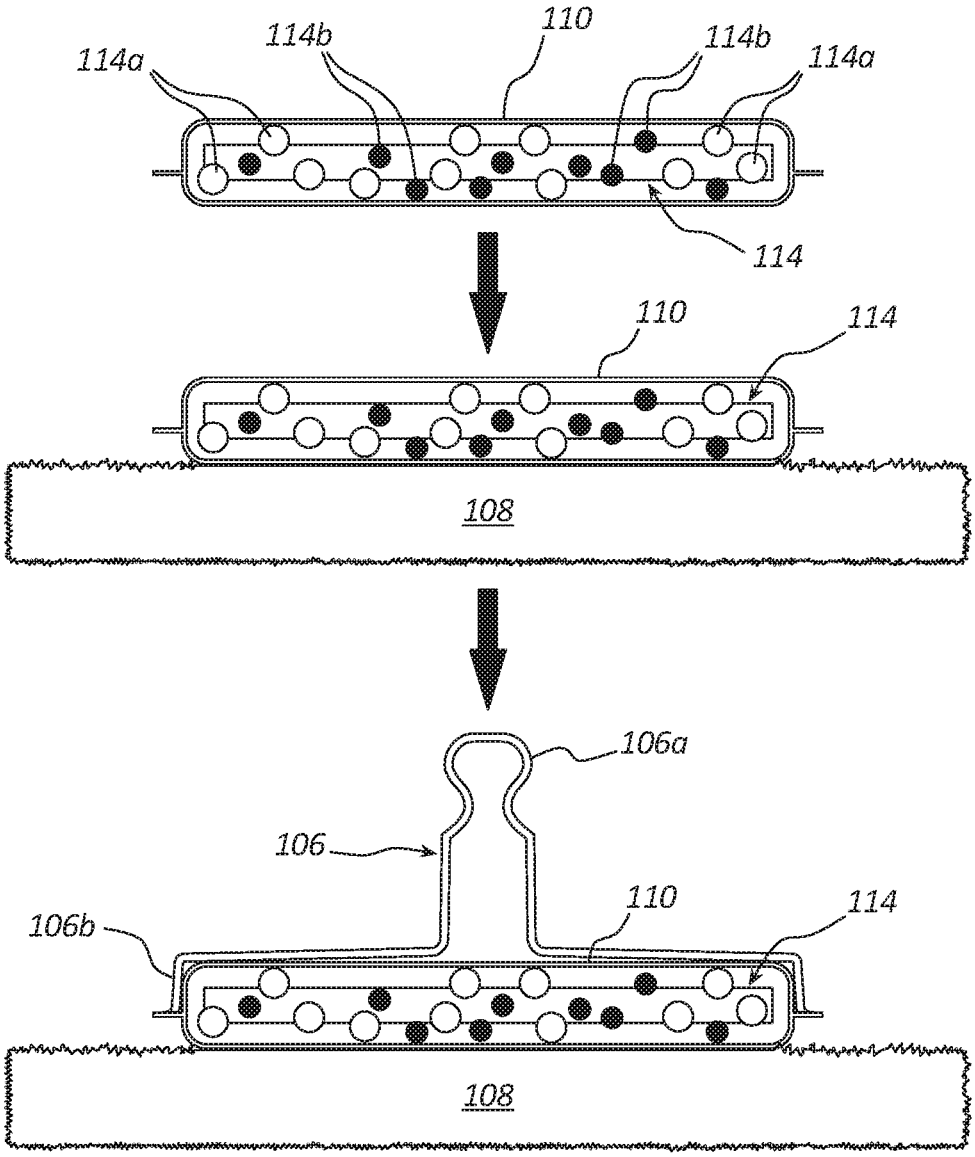
FIG. 5 schematically illustrates steps in an exemplary method of manufacture, where the solid bleach and solid surfactant are introduced into a nonwoven pouch (e.g., which may initially be open on one side to allow introduction of the solids therein), followed by bonding of the nonwoven pouch to the scrubbing layer of the cleaning head, and attachment of the fitment over the nonwoven pouch.

FIG. 5 schematically shows how the nonwoven material may be configured as a pouch, e.g., initially open on one end, so as to allow it to be filled with the solid components 114*a* and 114*b* (the solid bleach and solid surfactant). The nonwoven material may be bonded (e.g., sonically bonded) to the scrubbing layer 108. There may be no contact of any glue, adhesive, or other material that may react with (and inactivate or otherwise contaminate) the solid bleach or solid surfactant. Sonic bonding, or other bonding techniques that do not require an actual adhesive may be preferred for this reason. Any opening initially present in the nonwoven pouch or other nonwoven substrate may similar be closed without use of a glue or other adhesive. Once the nonwoven material is bonded to the scrubbing layer, the fitment 106 may then be positioned and bonded over the non-woven material 110. In an embodiment, the lower portion of fitment 106*b* may cover the top of the nonwoven material 110. Fitment 106 may comprise a water impermeable material (e.g., an injection molded or thermoformed polymer such as polyethylene). Water may reach solid composition 114 by penetrating through scrubbing layer 108 and nonwoven 110, into cavity 112. The dissolved solid composition then diffuses outward to the bottom surface of scrubbing layer 108.

IV. Examples

Example 1

Various solid bleach components were tested to determine their dissolution and dusting characteristics. The tested components were as shown below in Table 1A.

TABLE 1A

| Solid Bleach | Available Chlorine % | Concentration for Micro-Efficacy (ppm) | Dissolution Time (to reach target ppm) | Dusting (1-6) |
|---|---|---|---|---|
| sodium dichlorisocyanurate | 56% | 500 | 45 s | 1 |
| Trichlorocyanuric acid | 90% | 311 | 20 min | 3 |
| Calcium hypochlorite | 65% | 430 | 2 min | 3 |
| Magnesium Intercalated Bleach | 83% | 337 | 3 days | N/A |

The dusting level was determined based on the qualitative scale shown below in Table 1B.

TABLE 1B

| Dusting Level | Dusting Characteristics |
|---|---|
| 1 | Some dust during manufacture, but no dust during consumer use |
| 2 | Very little dust during manufacture and/or consumer use |
| 3 | Very noticeable dust during manufacture and/or consumer use |
| 4 | Dust levels that may inhibit manufacture or safe consumer use |
| 5 | Dust considered unsafe for consumer use |
| 6 | Dust requiring fume hood when container of solid bleach/surfactant is opened |

As shown in Tables 1A-1B, the sodium dichlorisocyanurate (SDIC) exhibited very quick dissolution, and exhibited minimal dusting. The trichlorocyanuric acid dissolution time was 20 minutes, which is long as a practical matter for use in a toilet bowl wand as described herein. The 3 day dissolution time of the tested magnesium intercalated bleach is similarly too long, as a practical matter. For example, the selected solid bleach may dissolve to provide the desired target ppm concentration of chlorine within 2 minutes, within 1 minute, or the like. Dusting was measured on a qualitative scale from 1 to 6, with 1 being the best (minimal dusting). Both the tested calcium hypochlorite and the trichlorocyanuric acid exhibit dusting of "3", which was a moderate value. The tested SDIC exhibit a very desirable combination of properties relative to dusting and dissolution.

Example 2

Various concentrations of sodium dichlorisocyanurate (SDIC) were tested for microefficacy against *Staphylococcus aureus*. In Example 2, concentrations of 10 ppm, 50 ppm, and 150 ppm were tested at contact periods of 15 seconds, 30 seconds, 45 seconds, 1 minute, 2 minutes, and 5 minutes. The test method included preparing a 48 hr. *Staphylococcus aureus* culture (*Staphylococcus aureus* ATCC 6538), which was diluted 1:2 with synthetic broth. A 5% organic soil load (fetal bovine serum) was added to the diluted culture to produce a suspension with 5% fetal bovine serum. This suspension was used as the test inoculum.

A 20 μL aliquot of the prepared suspension was added and spread on the bottom wells in a sterile 6-plastic well plate. The plates were then dried at 35° C. for 30 minutes. A 1 mL aliquot of test sample was added to the dried inoculum and allowed to sit for the given contact time (e.g., 15 s-5 min). At the end of the contact time, 4 mL of neutralizer (Letheen broth+0.1% sodium thiosulfate) was added to the well and the plate was swirled. 0.1 and 1.0 mL aliquots were then plated from the wells and/or the wells were further diluted and plated. Control plates were "treated" by adding 1 mL PBS to the dried inoculum followed by 4 mLs of neutralizer. The contents of the well were mixed, serially diluted, and plated. The counts were used to determine the percent reduction of the test samples. For the control plate carrier population control, the average population was 6.47 log cfu. Each test included 3 replicates.

The percent reduction results for 10 ppm-150 ppm SDIC concentration at 15 s-5 minutes are shown below in Table 2.

TABLE 2

| | 15 s | 30 s | 45 s | 1 min | 2 min | 5 min |
|---|---|---|---|---|---|---|
| 10 ppm | — | — | 15.7% | 95% | 95% | 95% |
| 50 ppm | — | 21.4% | 15.3% | 95% | 95% | 95% |
| 150 ppm | 61.4% | 56.5% | 59.9% | 95% | 95% | 95% |

Example 2

Concentrations of 150 ppm, 300 ppm, and 500 ppm sodium dichlorisocyanurate (SDIC) were tested for microefficacy against *Staphylococcus aureus* for contact times of 2 minutes and 5 minutes. The test method included preparing a 48 hr. *Staphylococcus aureus* culture (*Staphylococcus aureus* ATCC 6538), which was diluted 1:2 with synthetic broth. A 5% organic soil load (fetal bovine serum) was added to the diluted culture to produce a suspension with 5% fetal bovine serum. This suspension was used as the test inoculum.

A 20 μL aliquot of the prepared suspension was added and spread on a 1"×1" glass carrier. The carriers were then dried at 35° C. for 40 minutes. After drying, the inoculated carriers were individually placed into sterile 50 mL sample jars with screw caps. A 5 mL aliquot of test sample was added to the carrier in the jar and allowed to sit for the contact time. The carrier was completely submerged in the liquid. At end end of the contact time, 20 mL of neutralizer was added to the jar. The jar was capped and the contents agitated. 0.1 and 1.0 mL aliquots were then plated from the jars and/or the jar contents were further diluted and plated. Control plates were "treated" by adding 5 mL PBS to the dried inoculum followed by 20 mLs of neutralizer. The contents of the jars were mixed, serially diluted, and plated. The counts were used to determine the percent reduction of the test samples. For the control plate carrier population control, the average population was 6.81 log cfu. Each test included 3 replicates.

The percent reduction results for 150 ppm-500 ppm SDIC concentration at 2 minutes and 5 minutes are shown below in Table 3.

TABLE 3

| | 2 min | 5 min |
|---|---|---|
| 150 ppm | 98.7% | 88.5% |
| 300 ppm | 83.8% | 100% |
| 500 ppm | 98.7% | 100% |

Example 3

Concentrations of 150 ppm, 300 ppm, and 500 ppm sodium dichlorisocyanurate (SDIC) were tested in combination with a 0.1% surfactant concentration for microefficacy against *Staphylococcus aureus* for contact times of 2 minutes and 5 minutes. The surfactant was sodium dodecylbenzene sulfonate. The test method was as described in Example 2, except for the inclusion of the surfactant in the tested compositions. The 150 ppm, 300 ppm, and 500 ppm solutions were prepared by diluting a stock SDIC solution at 1100 ppm to prepare 500 mL of each solution. Once the dilutions were prepared, 0.5 g of surfactant was added to each solution and mixed until dissolved. For the control plate carrier population control, the average population was 6.49 log cfu. Each test included 3 replicates.

The percent reduction results for 150 ppm-500 ppm SDIC concentration, with 0.1% surfactant at 2 minutes and 5 minutes are shown below in Table 4.

TABLE 4

| | 2 min | 5 min |
|---|---|---|
| 150 ppm | 83.6% | 93.4% |
| 300 ppm | 96.5% | 99.4% |
| 500 ppm | 93.4% | 100% |

Efficacy can be tested according to any applicable test method, e.g., EPA guideline OCSPP 810.2200, incorporated herein by reference in its entirety. For example, efficacy may be evaluated based on a toilet bowl volume of 96 fl. oz., to provide a 3-log reduction with a 5 minute exposure.

Without departing from the spirit and scope of this invention, one of ordinary skill can make various changes and modifications to the invention to adapt it to various usages and conditions. As such, these changes and modifications are properly, equitably, and intended to be, within the full range of equivalence of the following claims.

The invention claimed is:

1. A cleaning tool comprising:

(a) a nonwoven material having an exterior surface and an interior surface; and (b) a solid cleaning composition, stored adjacent to the interior surface of the nonwoven material, the solid cleaning composition comprising:

(i) a solid bleach; and (ii) a solid surfactant;

wherein the cleaning composition dissolves in water and releases from the nonwoven material to achieve at least a 3-log reduction in *Staphylococcus aureus* within 5 minutes.

2. A cleaning tool according to claim 1, wherein the solid bleach comprises sodium dichloroisocyanurate.

3. A cleaning tool according to claim 1, wherein the solid bleach comprises a dichloroisocyanurate, a trichloroisocyanurate, calcium hypochlorite, magnesium intercalated bleach, a hydantoin, a cyanuric acid, a solid peroxide or a combination thereof.

4. A cleaning tool according to claim 1, wherein the solid surfactant comprises a sulfate, a sulfonate or a combination thereof.

5. A cleaning tool according to claim 1, wherein the solid surfactant comprises sodium lauryl sulfate, sodium dodecylbenzene sulfonate, alpha olefin sulfonate, cocamide monoethanolamine, or a combination thereof.

6. A cleaning tool according to claim 1, wherein the cleaning composition further comprises a dye.

7. A cleaning tool according to claim 1, wherein the cleaning composition further comprises a fragrance.

8. A cleaning tool comprising:

(a) a handle;

(b) a nonwoven material having an exterior surface and an interior surface and wherein the nonwoven material is attached to or attachable to the handle; and (c) a solid cleaning composition, stored adjacent to the interior surface of the nonwoven material, the solid cleaning composition comprising:

(i) a solid bleach; and (ii) a solid surfactant;

wherein the cleaning composition dissolves in water and releases from the nonwoven material to achieve at least a 3-log reduction in *Staphylococcus aureus* within 5 minutes.

9. A cleaning tool according to claim 8, wherein the solid bleach comprises sodium dichloroisocyanurate.

10. A cleaning tool according to claim 8, wherein the solid bleach comprises a dichloroisocyanurate, a trichloroisocyanurate, calcium hypochlorite, magnesium intercalated bleach, a hydantoin, a cyanuric acid, a solid peroxide or a combination thereof.

11. A cleaning tool according to claim 8, wherein the solid surfactant comprises a sulfate, a sulfonate or a combination thereof.

12. A cleaning tool according to claim 8, wherein the solid surfactant comprises sodium lauryl sulfate, sodium dodecylbenzene sulfonate, alpha olefin sulfonate, cocamide monoethanolamine, or a combination thereof.

13. A cleaning tool according to claim 8, wherein the cleaning composition further comprises a dye.

14. A cleaning tool according to claim 8, wherein the cleaning composition further comprises a fragrance.

15. A cleaning tool according to claim 8, wherein the nonwoven substrate is in the form of a pouch.

16. A cleaning tool according to claim 15, wherein the solid cleaning composition is sealed within the pouch.

17. A cleaning tool comprising:

(a) a cleaning head;

(b) a nonwoven pouch attached to or attachable to the cleaning head; and (c) a solid cleaning composition, stored within the nonwoven pouch, the solid cleaning composition comprising:

(i) a solid bleach; and (ii) a solid surfactant;

wherein the cleaning composition dissolves in water and is released from said nonwoven pouch to achieve at least a 3-log reduction in *Staphylococcus aureus* within 5 minutes.

18. A cleaning tool according to claim 17, wherein the solid cleaning composition is sealed within the nonwoven pouch.

19. A cleaning tool according to claim 18, wherein the solid bleach comprises sodium dichloroisocyanurate.

20. A cleaning tool according to claim 17, wherein the solid cleaning composition is not in contact with any glue or adhesive.

* * * * *